United States Patent [19]

Uchida et al.

[11] Patent Number: 5,015,986

[45] Date of Patent: May 14, 1991

[54] ORGANIC POSITIVE TEMPERATURE COEFFICIENT THERMISTOR

[75] Inventors: Katsuyuki Uchida; Haruo Takahata, both of Nagaokakyo, Japan

[73] Assignee: Murata Manufacturing Co., Ltd., Japan

[21] Appl. No.: 505,566

[22] Filed: Apr. 6, 1990

[30] Foreign Application Priority Data

Apr. 6, 1989 [JP] Japan ..... 1-88629

[51] Int. Cl.[5] ..... H01C 7/10

[52] U.S. Cl. ..... 338/22 R; 219/548

[58] Field of Search ..... 338/22 R, 22 SD; 219/548, 546, 547, 552, 553, 541, 549; 374/185

[56] References Cited

U.S. PATENT DOCUMENTS

| | | | |
|---|---|---|---|
| 4,149,066 | 4/1979 | Niibe | 219/549 X |
| 4,418,272 | 11/1983 | Roller et al. | 219/541 |
| 4,733,057 | 3/1988 | Stanzel et al. | 219/548 |
| 4,954,696 | 9/1990 | Ishii et al. | 219/548 |

*Primary Examiner*—Bruce A. Reynolds
*Assistant Examiner*—Marvin M. Lateef
*Attorney, Agent, or Firm*—Ostrolenk, Faber, Gerb & Soffen

[57] ABSTRACT

In an organic positive temperature coefficient thermistor first and second power supplying portions are arranged spaced apart from each other by a predetermined distance on a sheet made of a material exhibiting a positive temperature characteristic of resistance. A respective plurality of branch-shaped electrodes is connected to each of the first and second power supplying portions. The plurality of branch-shaped electrodes connected to each of the power supplying portions is arranged so as to extend toward the side of the other power supplying portion. The branch-shaped electrodes connected to each of the power supplying portions are arranged so as to be interdigitated with the branch-shaped electrodes connected to the other power supplying portion. The organic positive temperature coefficient thermistor is characterized in that at least one of the first and second power supplying portions is constituted by a plurality of power supplying electrodes which are insulated from each other. A plurality of branch-shaped electrodes is connected to each of the plurality of power supplying electrodes, and they are distributed along the power supplying electrodes with a predetermined spacing and with a predetermined ratio between the respective members of branch-shaped electrodes on each of the power supplying electrodes.

8 Claims, 3 Drawing Sheets

ORGANIC POSITIVE TEMPERATURE COEFFICIENT THERMISTOR

BACKGROUND OF THE INVENTION

1. Field of the Invention

The present invention relates generally to organic positive temperature coefficient (PTC) thermistors used as face-like heating devices, and more particularly, to an organic positive temperature coefficient thermistor having an improvement in the structure of the electrodes that are formed on a sheet exhibiting a positive temperature characteristic of resistance.

2. Description of the Prior Art

For example, a material obtained by throughly mixing polyolefin such as polyethylene with conductive particles such as metal powder, carbon black or graphite exhibits a positive temperature characteristic of resistance. An organic positive temperature coefficient thermistor using a sheet made of this material can be used as a flexible face-like heating device.

In the above described organic positive temperature coefficient thermistor, the following electrode structure is formed on one surface of the sheet exhibiting a positive temperature characteristic of resistance. More specifically, this electrode structure has a pair of power supplying portions arranged opposed to each other and separated by a predetermined distance, and a plurality of branch-shaped electrodes electrically connected to the power supplying portions, respectively, and arranged so as to be inserted between each other (interdigitated) between the power supplying portions.

A face-like heating device utilizing this organic positive temperature coefficient thermistor can be kept at a constant temperature and can automatically control the heat generating temperature under abnormal conditions because it has a self-temperature control function. Consequently, it is superior in safety to a face-like heating device using a nichrome wire and a metal foil.

However, the organic positive temperature coefficient thermistor has the disadvantage in that it is very difficult to switch the temperature, that is, to change its output temperature because it has the above described self-temperature control function.

In the conventional organic positive temperature coefficient thermistor, the output is switched in the following manner. More specifically, a plurality of electrode structures as described above are formed on the sheet exhibiting a positive temperature characteristic of resistance, to construct a plurality of separate heat generating circuits. The electrical connections to the plurality of heat generating circuits can then be switched. That is, the heat generating circuits which are placed in the on state can be selected, so that the area in which heat is generated can be reduced to, for example, one-half or one-third of the area in a case where all the heat generating circuits are caused to generate heat.

In the above described structure, however, heat is generated on only part of the surface of the sheet exhibiting a positive temperature characteristic of resistance, that is, the portion where heat is generated and the portion where heat is not generated are completely divided. Accordingly, heat cannot be uniformly generated in the entire region where heat is desired to be generated.

SUMMARY OF THE INVENTION

An object of the present invention is to provide an organic positive temperature coefficient thermistor capable of changing its output while maintaining substantially uniform generation of heat over the entire region where heat is desired to be generated.

According to the present invention, an organic positive temperature coefficient thermistor has the following structure. More specifically, the organic positive temperature coefficient thermistor according to the present invention is constructed by using a sheet made of a material exhibiting a positive temperature characteristic of resistance obtained by dispersing conductive particles in an organic polymer material. First and second power supplying portions are arranged opposed to each other and separated by a predetermined distance on one surface of this sheet. A plurality of branch-shaped electrodes are each respectively connected to one of the first and second power supplying portions and extend in the direction of the opposite power supplying portions, that is, in the direction of the second and first power supplying electrodes. In addition, the plurality of branch-shaped electrodes connected to the first or second power supplying portion are arranged so as to be interdigitated with the plurality of branch-shaped electrodes connected to the second or first power supplying portion. In the present invention, at least one of the above described first and second power supplying portions comprises a plurality of power supplying electrodes which are insulated from each other, and the above described plurality of branch-shaped electrodes connected to that power supplying portion are distributed between the plurality of power supplying electrodes and are connected and spaced along to the plurality of power supplying electrodes in a predetermined manner, and there is a predetermined ratio between the respective numbers of branch-shaped electrodes attached to each of the power supplying electrodes.

In the present invention, the plurality of branch-shaped electrodes connected to the power supplying portion comprising the plurality of power supplying electrodes are connected to the plurality of power supplying electrodes in a distributed manner at a predetermined ratio. Accordingly, the power output of the organic positive temperature coefficient thermistor can be changed by selecting a method of supplying power to the plurality of power supplying electrodes, that is, by selecting the power supplying electrodes to which power is supplied. On the other hand, the plurality of branch-shaped electrodes are connected to the plurality of power supplying electrodes in a distributed manner and with a predetermined numerical ratio and spacing. Accordingly, heat can be uniformly generated in almost the entire region where it is desired that heat is generated even if the output is switched.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

The construction of the present invention will be made apparent by explaining embodiments of the present invention, it being understood that the disclosure is for the purpose of illustration and not limitation.

Figure 1:
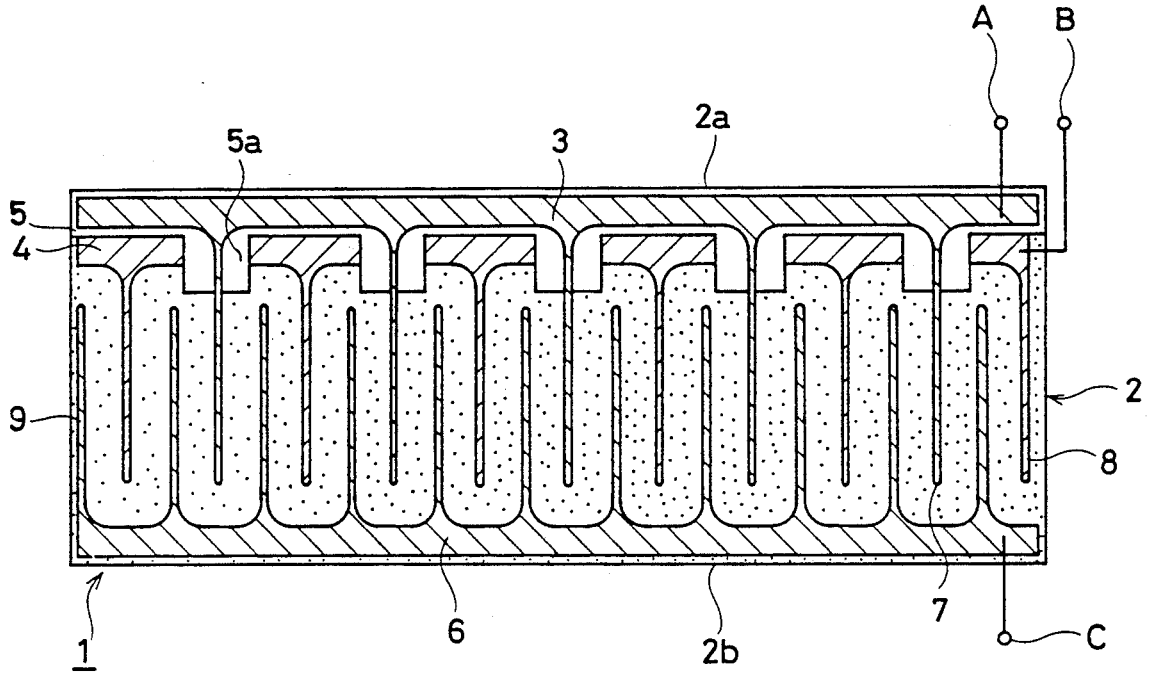
FIG. 1 is a plan view showing an organic positive temperature coefficient thermistor according to an embodiment of the present invention.

FIG. 1 is a plan view showing an organic positive temperture coefficient thermistor. An organic positive temperature coefficient thermistor 1 is constructed by using a sheet 2 made of a material exhibiting a positive temperature characteristic of resistance. This sheet 2 is adapted so as to exhibit a positive temperature characteristic of resistance by dispersing conductive particles such as metal powder, carbon black or graphite in an organic polymer material.

As the organic polymer material, an olefin such as polyethylene can be taken as an example. In addition to this, any arbitrary organic polymer material can be used, provided that conductive particles can be dispersed therein.

Furthermore, any arbitrary conductive material such as carbon black, metal powder or graphite can be used as the conductive particles. In general, the conductive particles are thoroughly mixed with the organic polymer material and formed by a suitable molding method; or a film made of a material obtained by the above-mentioned thorough mixing is laminated on a plate-shaped insulating member, thereby to obtain the sheet 2.

On the upper surface of the sheet 2, first and second power supplying portions are arranged spaced apart from each other by a predetermined distance along first and second side edges 2*a* and 2*b* of the sheet 2.

According to the present embodiment, the first power supplying portion comprises two power supplying electrodes 3 and 4. The power supplying electrodes 3 and 4 are insulated from each other by an insulating layer 5 (which is not hatched). A structure of a laminated portion of the power supplying electrodes 3 and 4 and the insulating layer 5 will be explained later.

On the other hand, the second power supplying portion comprises a power supplying electrode 6 formed along the second side edge 2*b* of the sheet 2.

A plurality of branch-shaped electrodes 7, 8 and 9 are formed so that each is electrically connected to a respective one of the above described power supplying electrodes 3, 4 and 6, respectively. The plurality of branch-shaped electrodes 7 and 8 respectively connected to the power supplying electrodes 3 and 4 constituting the first power supplying portion are arranged so as to be inserted between the plurality of branch-shaped electrodes 9 connected to the power supplying electrode 6 constituting the second power supplying portion.

On the side of the first power supplying portion, the branch-shaped electrodes 7 connected to the power supplying electrode 3 and the branch-shaped electrodes 8 connected to the power supplying electrode 4 are alternately arranged in the direction in which the side edge 2*a* extends.

Figure 2:
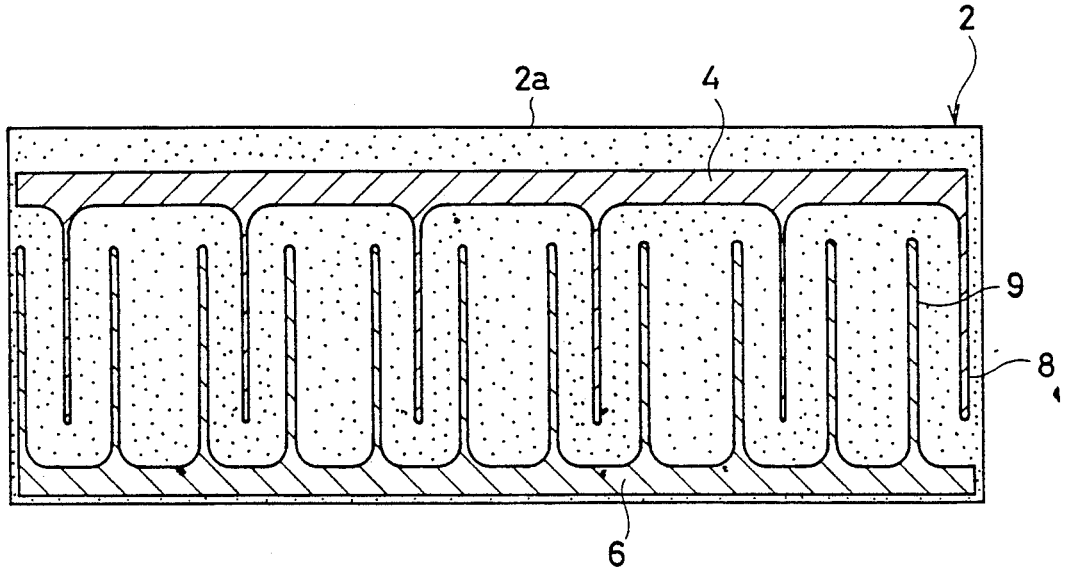
FIG. 2 is a plan view showing a manufacturing step where power supplying portions and branch-shaped electrodes are formed on the upper surface of a sheet of the organic positive temperature coefficient thermistor shown in FIG. 1.

As shown in FIG. 2, to fabricate the organic positive temperature coefficient thermistor according to the present embodiment, a power supplying electrode 4 and branch-shaped electrodes 8 as well as a power supplying electrode 6 and branch-shaped electrodes 9 are first formed on the upper surface of a sheet 2 by applying conductive materials. For example, they can be formed by applying and drying conductive pastes mainly composed of metal materials such as Ag, Ni or Cu as shown in FIG. 2 or affixing metal foils such as aluminum foils.

Additionally, the power supplying electrodes 4 and 6 and the branch-shaped electrodes 8 and 9 may be formed of different conductive materials. For example, the power supplying electrodes 4 and 6 may be formed of metal foils, while the branch-shaped electrodes 8 and 9 may be formed of conductive pastes.

Figure 3:
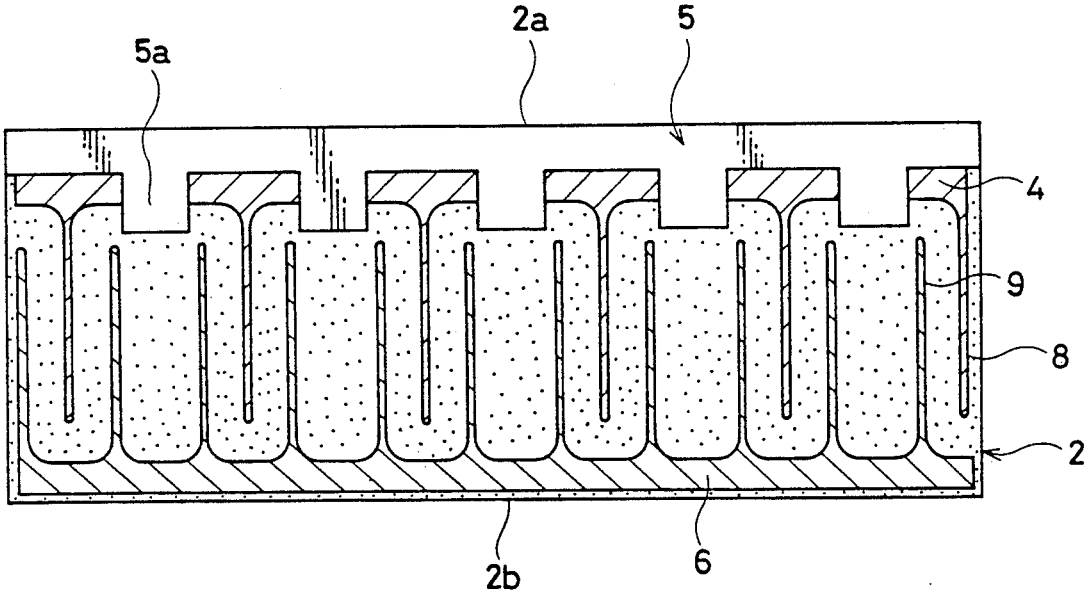
FIG. 3 is a plan view for explaining a step where an insulating layer is formed.

As shown in FIG. 3, an insulating layer 5 is then formed so as to coat a part of the power supplying electrode 4 along the first side edge 2*a* of the sheet 2 and have a plurality of projections 5*a*. This insulating layer 5 can be formed of any arbitrary insulating resin. The insulating layer 5 is provided so as to insulate the power supplying electrodes 3 and 4 from each other as described above. It may be formed in a shape other than the shape as shown so long as the object can be attained.

Finally, the power supplying electrode 3 and the plurality of branch-shaped electrodes 7 as shown in FIG. 1 are formed on the insulating layer 5. This power supplying electrode 3 and these branch-shaped electrodes 7 can be formed of the same materials as those of the above described power supplying electrodes 4 and 6 and the above described branch-shaped electrodes 8 and 9 and using the same method. However, the power supplying electrode 3 must be insulated from the power supplying electrode 4 through the insulating layer 5. Accordingly, the power supplying electrode 3 must be made narrower than the insulating layer 5 as shown.

In the organic positive temperature coefficient thermistor 1 shown in FIG. 1, the first power supplying portion comprises two power supplying electrodes 3 and 4, and the branch-shaped electrodes 7 and 8 inserted between the branch-shaped electrodes 9 connected to the second power supplying portion are alternately connected to the power supplying electrodes 3 and 4 in a distributed manner spaced apart along the edge 2*a*. Consequently, its highest output can be obtained if power is supplied from both of the power supplying electrodes 3 and 4 and from the power supplying electrode 6.

Furthermore, the amount of heat generated can be sintered by stopping the supply of power from any one of the power supplying electrodes 3 and 4, thereby lowering the heat output. Moreover, in either case, the branch-shaped electrodes 7 to 9 contributing to heat generation are almost uniformly distributed on the upper surface of the sheet 2. Accordingly, heat can be uniformly generated on the whole surface even if the output is switched.

Also note that the number of the branch-shaped electrodes 7 connected to the power supplying electrodes 3 is made different from the number of the branch-shaped electrodes 8 connected to the power supplying electrodes 4. Accordingly, the amount of heat generated can be switched by either stopping the supply of power to the power supplying electrode 3, or stopping the supply of power to the power supplying electrode 4.

More specifically, in the organic positive temperature coefficient thermistor 1 according to the present embodiment, the output can be switched to three stages while maintaining almost uniform heat generation in the entire region where heat is desired to be generated.

Specific experimental results obtained with the present invention will now be described.

A sheet, which measures 50×130 mm, obtained by dispersing carbon black in a sheet made of a polyethylene is prepared as the sheet 2. Power supplying electrodes 3, 4 and 6 and branch-shaped electrodes 7 to 9 are formed on one major surface of this sheet 2 by screen-process printing of Ag pastes. The insultating layer interposed between the power supplying electrodes 3 and 4 is formed by applying and drying silicone resins in the shape shown in FIG. 3.

An aluminum plate having a thickness of 0.2 mm is affixed to the reverse side of the organic positive temperature coefficient thermistor obtained in the above described manner using a pressure sensitive adhesive double coated tape. The the resistance of the organic positive temperature coefficient thermistor and the output power are measured at the time of applying a direct current of 12 V. The results of the measurement are shown in the following Table 1.

TABLE 1

| Terminal (see FIG. 1) | Resistance value (Ω) | Power (W) |
|---|---|---|
| A-C | 8.52 | 3.22 |
| B-C | 6.43 | 3.60 |
| A, B-C | 4.15 | 4.00 |

As obvious from Table 1, the power consumption can be switched in three stages, that is, the amount of heat generated can be switched in three stages by switching a method of electrical connection of the power supplying electrodes. In addition, the temperature distributions on the aluminum plate are examined. Consequently, in any of the above described three heat generating arragements, the temperature distributions have the same tendency.

Figure 4:
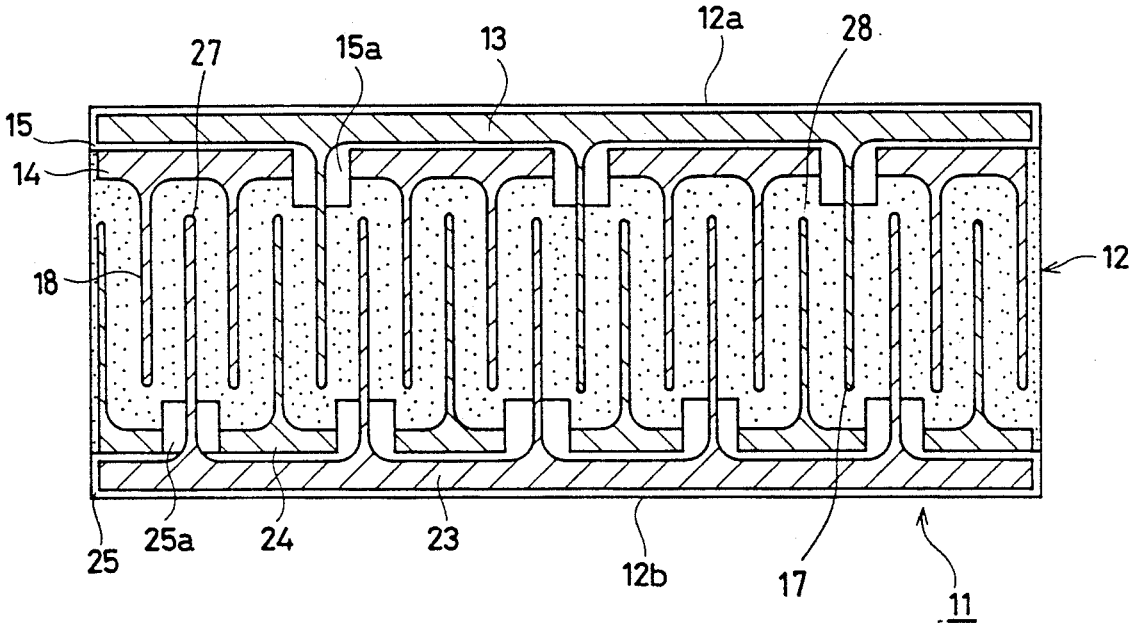
FIG. 4 is a plan view for explaining an organic positive temperature coefficient thermistor according to another embodiment of the present invention.

FIG. 4 is a plan view showing an organic positive temperature coefficient thermistor according to another embodiment of the present invention. In an organic positive temperature coefficient thermistor 11 shown in FIG. 4, first and second power supplying portions are formed spaced apart from each other by a predetermined distance along first and second side edges 12*a* and 12*b* on the upper surface of a sheet 12 exhibiting a positive temperature characteristic of resistance.

The first power supplying portion along the side edge 12*a* has two power supplying electrodes 13 and 14. The power supplying electrodes 13 and 14 are insulated from each other by an insulating layer 15. In addition, a plurality of branch-shaped electrodes 17 and 18 extending toward the side of the second power supplying portion are respectively connected to the power supplying electrodes 13 and 14. This structure is almost the same as that of the first power supplying portion formed on the side of the side edge 2*a* in the organic positive temperature coefficient thermistor shown in FIG. 1 except that the ratio of the number of electrodes 17 to the number of electrodes 18 is different from the corresponding ratio of the number supplying electrodes 13 and 14 at a different ratio from branch-shaped electrodes 7 to the number of electrodes 8.

On the other hand, the second power supplying portion formed along the side edge 12*b* has power supplying electrodes 23 and 24. The power supplying electrodes 23 and 24 are electrically insulated from each other by an insulating layer 25. A plurality of branch-shaped electrodes 27 and 28 are respectively connected to the power supplying electrodes 23 and 24. This structure is the same as that of the first power supplying portion in the organic positive temperature coefficient thermistor 1 shown in FIG. 1. Therefore, the detailed description of the structure is not repeated.

In the organic positive temperature coefficient thermistor 11 shown in FIG. 4, a respective plurality of branch-shaped electrodes is distributed along each of the power supplying electrodes 13, 14, 23 and 24 that is, on the side of not only the first power supplying portion but also the second power supplying portion. Accordingly, the heat output of the organic positive temperature coefficient thermistor 11 can be switched in more stages than with the organic positive temperature coefficient thermistor 1 according to the embodiment shown in FIG. 1, by changing the method of the connection to the power supplying electrodes 13, 14, 23 and 24.

As obvious from the electrode structure of the organic positive temperature coefficient thermistor 11 according to the embodiment shown in FIG. 4, the number and spacing of the branch-shaped electrodes connected to each of the power supplying portion comprising a plurality of power supplying electrodes may be suitably changed. In addition, it is found that both the first and second power supplying portions may be formed so as to respectively have a plurality of power supplying electrodes.

That is, in the present invention, there can be more than two power supplying electrodes constituting at least one of the power supplying portions. For example, three or more power supplying electrodes may be formed.

Additionally, the positions where the first and second power supplying portions are formed need not be along the side edges of the sheet or in the vicinity of the side edges unlike the above described embodiments. More specifically, first and second power supplying portions may be formed in a central region of the sheet and a plurality of branch-shaped electrodes may be arranged therebetween. In addition, the above described heat generating circuits may be independently formed in a plurality of regions of a single sheet.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An organic positive temperature coefficient thermistor, comprising:

a sheet made of a material exhibiting a positive temperature characteristic of resistance made of conductive particles dispersed in an organic polymer material;

first and second conductive power supplying portions arranged opposed to each other and separated by a predetermined distance on said sheet; and first and second pluralities of branch-shaped electrodes respectively connected to said first and second power supplying portions and each said plurality of branch-shaped electrodes extending in the direction of the respective opposed power supplying portion, the plurality of branch-shaped electrodes connected to one of the power supplying portions being interdigitated with the plurality of branch-shaped electrodes connected to the other power supplying portion;

wherein at least a selected one of said first and second power supplying portions comprises a plurality of power supplying electrodes which are insulated from each other, and each electrode of said plurality of branch-shaped electrodes connected to the selected power supplying portion is connected to a respective one of the plurality of power supplying electrodes, and said branch-shaped electrodes are spaced along their respective power supplying electrodes with a predetermined ratio between the respective number of branch-shaped electrodes connected to each of the power supplying electrodes.

2. The organic positive temperature coefficient thermistor according to claim 1, wherein each of said first and second power supplying portions comprises a respective plurality of power supplying electrodes which are insulated from each other, and there is a plurality of branch-shaped electrodes connected to each of the power supplying electrodes, spaced along the same with a predetermined spacing, and with a predetermined ratio between the respective number of branch-shaped electrodes connected to each of the power supplying electrodes.

3. The organic positive temperature coefficient thermistor according to claim 1, further comprising an insulating layer inserted between the plurality of power supplying electrodes which are insulated from each other, said plurality of power supplying electrodes being laminated together with the insulating layer.

4. The organic positive temperature coefficient thermistor according to claim 1, wherein different numbers of branch-shaped electrodes are respectively connected to each of said plurality of power supplying electrodes.

5. The organic positive temperature coefficient thermistor according to claim 1, wherein said first power supplying portion comprises two power supplying electrodes which are insulated from each other.

6. The organic positive temperature coefficient thermistor according to claim 5, wherein the plurality of branch-shaped electrodes connected to said first power supplying portion are alternately connected to said two power supplying electrodes and spaced along the direction in which said first power supplying portion extends.

7. The organic positive temperature coefficient thermistor according to claim 1, wherein one said power supplying portion and its connected branch-shaped electrodes are made of the same conductive materials.

8. The organic positive temperature coefficient thermistor according to claim 1, wherein one said power supplying portion and its connected branch-shaped electrodes are made of different conductive materials.

* * * * *